US006125758A

United States Patent [19]

Sato et al.

[11] Patent Number: 6,125,758

[45] **Date of Patent: *Oct. 3, 2000**

[54] METHOD FOR VARYING THE PILING-ORDER AND/OR TURNING WEBS UPSIDE DOWN IN A ROTARY PRESS

[75] Inventors: Masayoshi Sato; Shinji Kawashima, both of Kawasaki; Yuko Tomita, Akishima; Tadashi Naoi, Fukuoka, all of Japan

[73] Assignee: K.K. Tokyo Kikai Seisakusho, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/701,558

[22] Filed: Aug. 22, 1996

Related U.S. Application Data

[62] Division of application No. 08/375,227, Jan. 19, 1995, abandoned, which is a continuation of application No. 08/096,580, Jul. 23, 1993, abandoned, which is a continuation-in-part of application No. 07/951,399, Sep. 25, 1992, abandoned.

[30] Foreign Application Priority Data

Mar. 13, 1992 [JP] Japan ..... P4-108111

[51] Int. Cl.[7] ..... B41F 5/04; B41F 5/06; B41F 5/10

[52] U.S. Cl. ..... 101/479; 101/480; 101/483; 101/178; 101/211; 101/219

[58] Field of Search ..... 101/181, 183, 101/479, 177, 182, 216, 219, 480, 483, 178, 211

[56] References Cited

U.S. PATENT DOCUMENTS

| | | | |
|---|---|---|---|
| 1,977,812 | 10/1934 | Swift, Jr. | 101/181 X |
| 2,557,381 | 6/1951 | Huebner | 101/180 |
| 3,761,001 | 9/1973 | Bolza-Schunemann | 101/181 X |
| 4,239,001 | 12/1980 | Kataoka | 101/152 |
| 4,449,450 | 5/1984 | Barny et al. | 101/183 |
| 4,520,454 | 5/1985 | Dufour et al. | 364/900 |
| 4,774,883 | 10/1988 | Mailander | 101/137 |
| 4,861,326 | 8/1989 | Kuhner et al. | 493/359 |
| 4,887,529 | 12/1989 | Ichikawa et al. | 101/181 |
| 4,960,048 | 10/1990 | Sarda | 101/247 |
| 5,074,205 | 12/1991 | Morgan | 101/247 |

OTHER PUBLICATIONS

"Printing Technology Handbook", first edition, Jul. 20, 1983, Gihodo Shuppan K.K., p. 889 and Figure 5.13.

"Recent Newspaper Production Primary Equipments", May 17, 1986, a Corporation of Nippon Shimbun Kyokai, p. 335.

*Primary Examiner*—Kimberly Asher

*Attorney, Agent, or Firm*—Trexler, Bushnell, Giangiorgi & Blackstone, Ltd.

[57] ABSTRACT

A rotary press can vary the order of piling of printed traveling webs freely without requiring the bay window device to the construction and thus contributes for reducing size and weight of the rotary press. Also, the rotary press may facilitate repairing and maintenance operation so that repairing of each unit, maintenance, cleaning or so forth can be done certainly and quickly. The rotary press includes printing units and a folding unit arranged in parallel and further comprises moving means for re-arranging at least two of the units among set units and/or orientation means for turning at least one of the unit over 180°.

11 Claims, 7 Drawing Sheets

METHOD FOR VARYING THE PILING-ORDER AND/OR TURNING WEBS UPSIDE DOWN IN A ROTARY PRESS

RELATED APPLICATIONS

The present application is a divisional of patent application Ser. No. 08/375,227, filed on Jan. 19, 1995, now abandoned, which is a continuation of patent application Ser. No. 08/096,580, filed on Jul. 23, 1993, now abandoned, which is a continuation-in-part of patent application Ser. No. 07/951,399, filed on Sep. 25, 1992, now abandoned.

BACKGROUND OF THE INVENTION

1. Field of the Invention

The present invention relates to a method for varying the order of piling and/or turning multiple webs upside down in a rotary press having multiple printing units to which the multiple webs are distributed, where the multiple webs are gathered to a folding unit, without requiring a bay window device.

2. Description of the Background Art

A typical construction of a rotary press for printing newspaper or so forth have been disclosed in "printing Technology Handbook", first edition, Jul. 20, 1983, Gihodo Shuppan K. K., page 889 and FIG. 5.13.

The construction of respective parts of the newspaper printing rotary press as illustrated in FIG. 5.13 of the above-identified publication has been illustrated in relatively detail in the drawings of "Recent Newspaper Production Primary Equipments", May 17, 1986, a Corporation of Nippon Shinbun Kyokai, page 335. The drawing is shown in FIG. 12 of the accompanying drawings.

A newspaper printing rotary press illustrated in FIG. 12 comprises a plurality of feeder units 21, 21, 21, 21 disposed in parallel relationship between a base frame 1 and a machine base 4, a plurality of printing unit 22, 22, 22, 22 arranged in parallel on the machine base 4, normally single folding unit 23 mounted on the machine base 4 commonly to the printing units, and a bay window device 24*a* mounted on an uppermost rail frame 24. Particularly, the printing units and the folding units are arranged at respectively predetermined positions on the machine base 4. The arrangements of these printing units and the folding unit are generally fixed.

The printing unit 22 generally includes monocolor printing units 22*a*, 22*a*, 22*a*, 22*a* for performing black printing or black printing plus spot mono-color auxiliary printing, and a color printing unit 22*b* for performing generally four color printing of black, magenta, yellow and cyan. The bay window device 24*a* includes a large number of turn bars and guide rollers for varying order of piling of a plurality of traveling webs W, W, W, W printed by the mono-color printing units in order to arrange the traveling web W printed by the color printing unit 22*b* at a desired page of the newspaper.

In view of the traveling path of the web W, the web is not directly supplied to the color printing unit 22*b* but is supplied after black printing by one of the mono-color printing unit 22*a*. Therefore, it can be said that the color printing unit 22*b* is arranged in series to the mono-color printing unit 22*a* with respect to the traveling path of the web W. However, in physical position, the color printing unit 22*b* can be regarded as printing unit arranged in parallel to other printing units on the machine base 4. Similarly to other printing units, the color printing unit 22*b* is arranged at the fixed position.

On the other hand, as illustrated, the monocolor printing unit 22*a* arranged adjacent the color printing unit 22*b* is arranged at higher position that remaining mono-color printing units 22*a* in order to supply the traveling web W to the color printing unit 22*b*.

With the construction set forth above, respective traveling webs W, W, W, W fed from respective feeder units 21, 21, 21, 21 are printed by respectively corresponding mono-color printing units 22*a*, 22*a*, 22*a*, 22*a*. The traveling web W printed one of the mono-color printing unit 22*a* is further fed and printed by the color printing unit 22*b*. All of the printed webs are guided to the folding unit 23 via the bay window device 24*a* including the large number of turn bars and the guide rollers so that the traveling webs are piled in the given order, cut and folded to be discharged as products.

As set forth above, the bay window device 24*a* is required for disposing the color printed web W printed by the color printing unit 22*b* to a desired page of the newspaper by controlling order of piling of the color printed web W relative to the printed webs W, W, W printed by the mono-color printing units.

However, as shown in FIG. 12, the bay window device 24*a* requires distribution of the large number of turn bars and the guide rails in a wide area to inherently cause increasing of the size of the machine. In addition, the bay window device 24*a* forms very complicated traveling path of respective traveling webs. Therefore, it has been a labor intensive work to pass the webs through such complicated traveling paths of respective webs. Furthermore, it inherently cause error in routing the traveling path of the webs to cause substantial amount of waste papers.

On the other hand, in the repairing and maintenance of the printing unit or the folding unit, the personnel performing repairing and maintenance operation have to work in substantially limited spaces in the fixedly arranged units. It necessarily requires the personnel to perform operation in abnormal postures and thus causes long period and heavy work load. Also, it further requires high attention for safety.

SUMMARY OF THE INVENTION

In view of the above-mentioned problem in the prior art, it is an object of the present invention to provide a method for varying the order of piling and/or front or reverse side orientation of printing webs in a printing system, without requiring the bay window device 24*a* as shown in FIG. 12.

Another object of the invention is to provide a method for varying the order of piling and/or front or reverse side orientation of printing webs in a printing system in order to simplify the construction and reduce the size and weight of the printing system.

In said printing system comprising: at least two printing units and a folding unit arranged in regular orientation at each respective working stations; said webs being furnished to said printing units to be printed therethrough respectively; thereafter, when said webs are gathered to said folding unit as shown in FIG. 4; a method of the present invention comprising the following steps: replacing said working stations of said at least two printing units and rearranging said printing units in regular orientation at said replaced stations respectively; furnishing said webs to said printing units to be printed therethrough respectively; thereafter, gathering said printed webs to said folding unit as shown in FIG. 5.

A further method of the present invention also comprises the following steps: reorienting either one of said printing units 180° at said working station; furnishing said webs to said printing units to be printed therethrough respectively; reorienting one of said printed webs into reverse side up, leaving the other of printed webs in front side up; thereafter, gathering said printed webs to said folding unit as shown in FIGS. 6 and 7.

A yet further method of the present invention comprises the following additional steps: reorienting said folding unit 180° at said working station; furnishing said webs to said printing units to be printed therein respectively; thereafter, gathering said printed webs to said folding unit as shown in FIGS. 8 and 9.

BRIEF DESCRIPTION OF THE DRAWINGS

The present invention will be understood more fully from the following disclosure of the invention in terms of the preferred embodiment of the present invention. However, it should be clearly noted that the following disclosure is just for illustration and explanation and not exhaustive to the present invention.

FIG. 12 is a front elevation showing the conventional rotary press.

DESCRIPTION OF THE PREFERRED EMBODIMENT

Figure 2:
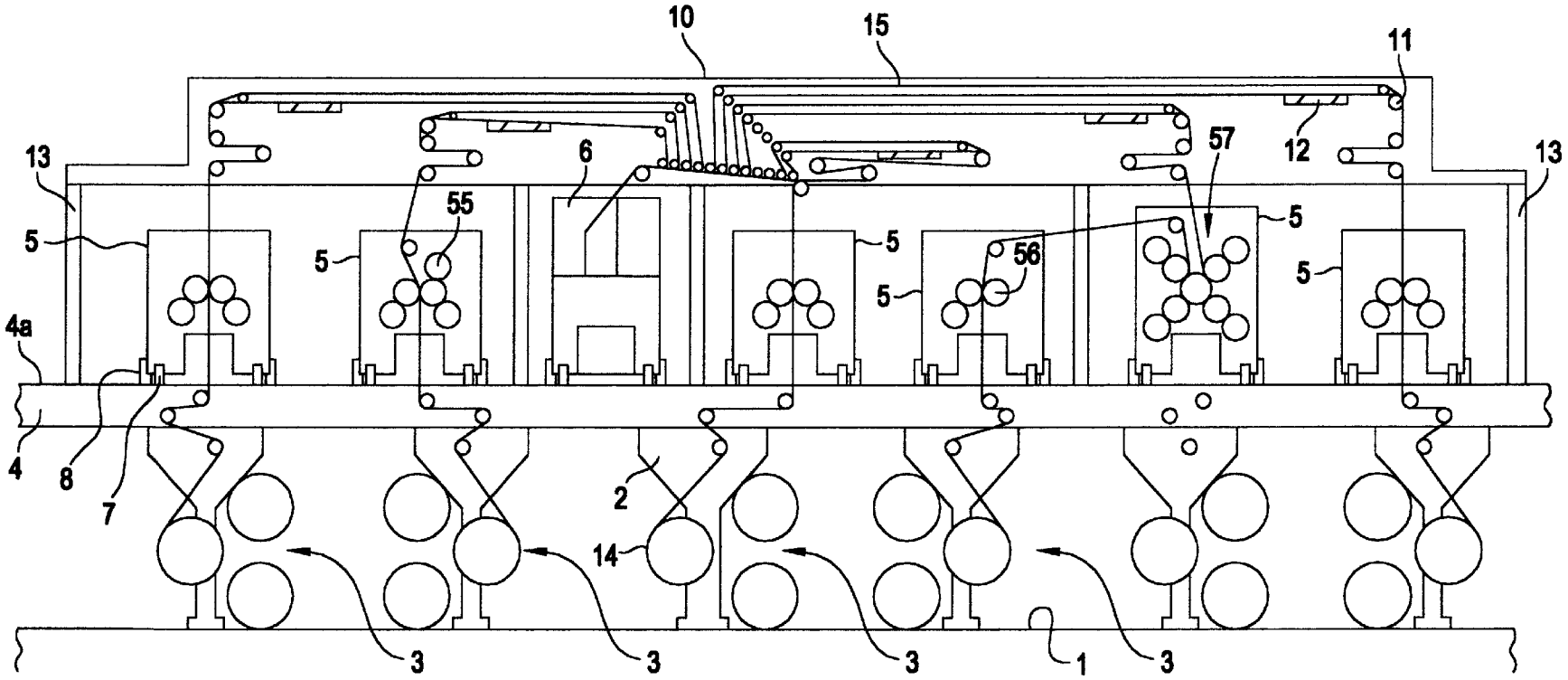
FIG. 2 is a front elevation of either embodiment of the rotary press according to the present invention.

FIG. 2 is a front elevation of a rotary press according to the present invention. In FIG. 2, a machine base 4 is supported on a plurality of machine legs 2 extending vertically from a base frame 1. Each machine leg 2 forms a core of a feeder unit 3, to which a web roll 14 is set. On a floor 4*a* defined at the even level on the upper surface of the machine base 4, printing units 5 and a folding unit 6 are arranged in parallel relationship to each other.

Figure 2A:
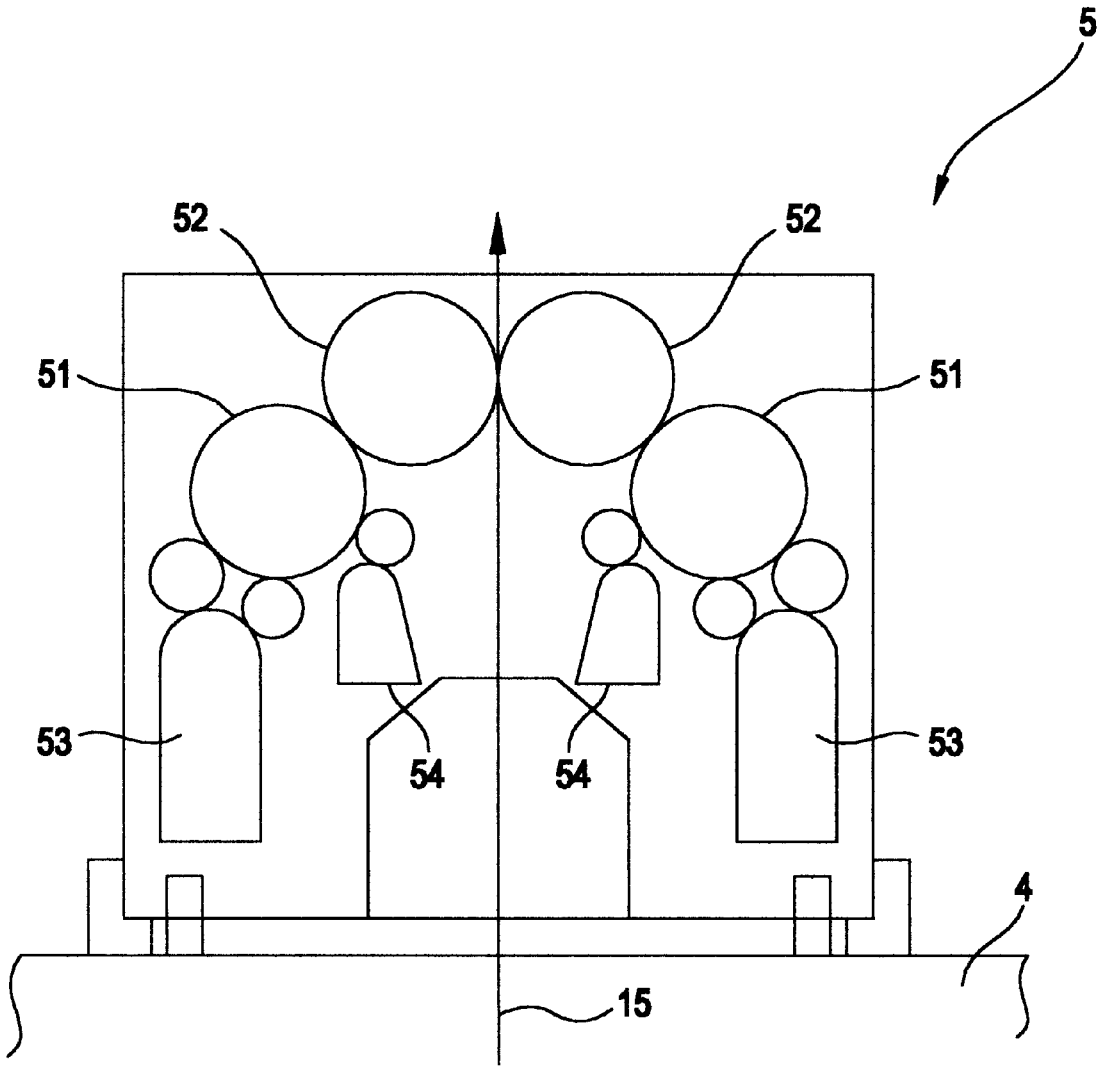
FIG. 2A is an enlarged, front elevational view of a typical example of a printing unit to be employed in the preferred embodiment of the rotary press of FIG. 2.

It should be appreciated that the word "printing unit" used throughout the disclosure and appended claims represents a complete set of components for printing. One typical example of the printing unit 5 is illustrated in FIG. 2A. The printing unit 5 illustrated in FIG. 2A includes so-called blanket-to-blanket type cylinder layout. Namely, the shown printing unit 5 includes a pair of plate cylinders 51, a pair of blanket cylinders 52 arranged in contact with respectively corresponding plate cylinders 51 and in contact with each other across a path of a web to be printed, a pair of inking units 53 and a pair of damping units 54 associated with respective plate cylinders 51. While the specific type of printing unit is illustrated in FIG. 2A, the present invention is applicable of any type of printing units. For instance, as can be seen from FIG. 2, one or more printing units 5 in the rotary press may include an additional cylinder 55 for a color spot deck, or an impression cylinder 56 in place of one of the blanket cylinder. Furthermore, the printing unit may have a so-called satellite type cylinder layout 47. In all cases, each printing unit 5 includes a complete set of cylinder set, i.e. a set of plate cylinder, blanket cylinder, impression cylinder, and accessories, such as an inking arrangement, damping arrangement so that each individual printing unit may independently perform printing operation. Preferred construction of the additional cylinder for the color spot deck has been disclosed in the commonly owned co-pending U.S. patent application Ser. No. 07/767,535. The disclosure of the above-identified co-pending U.S. Patent Application is herein incorporated by reference.

Figure 1A:
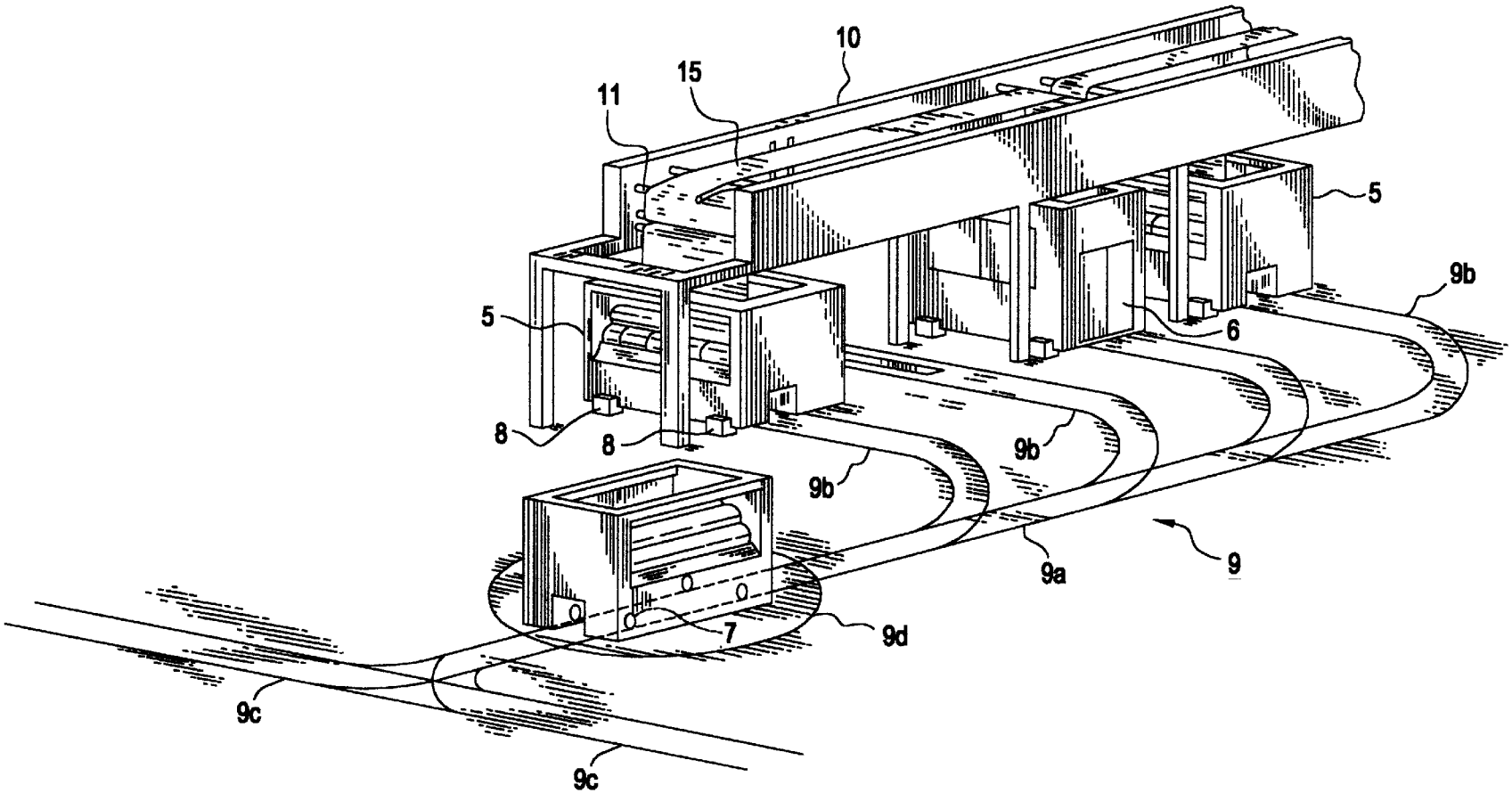
FIG. 1*a* is a perspective view fragmentarily illustrating the overall construction of a rotary press according to one embodiment of the present invention.
Figure 1B:
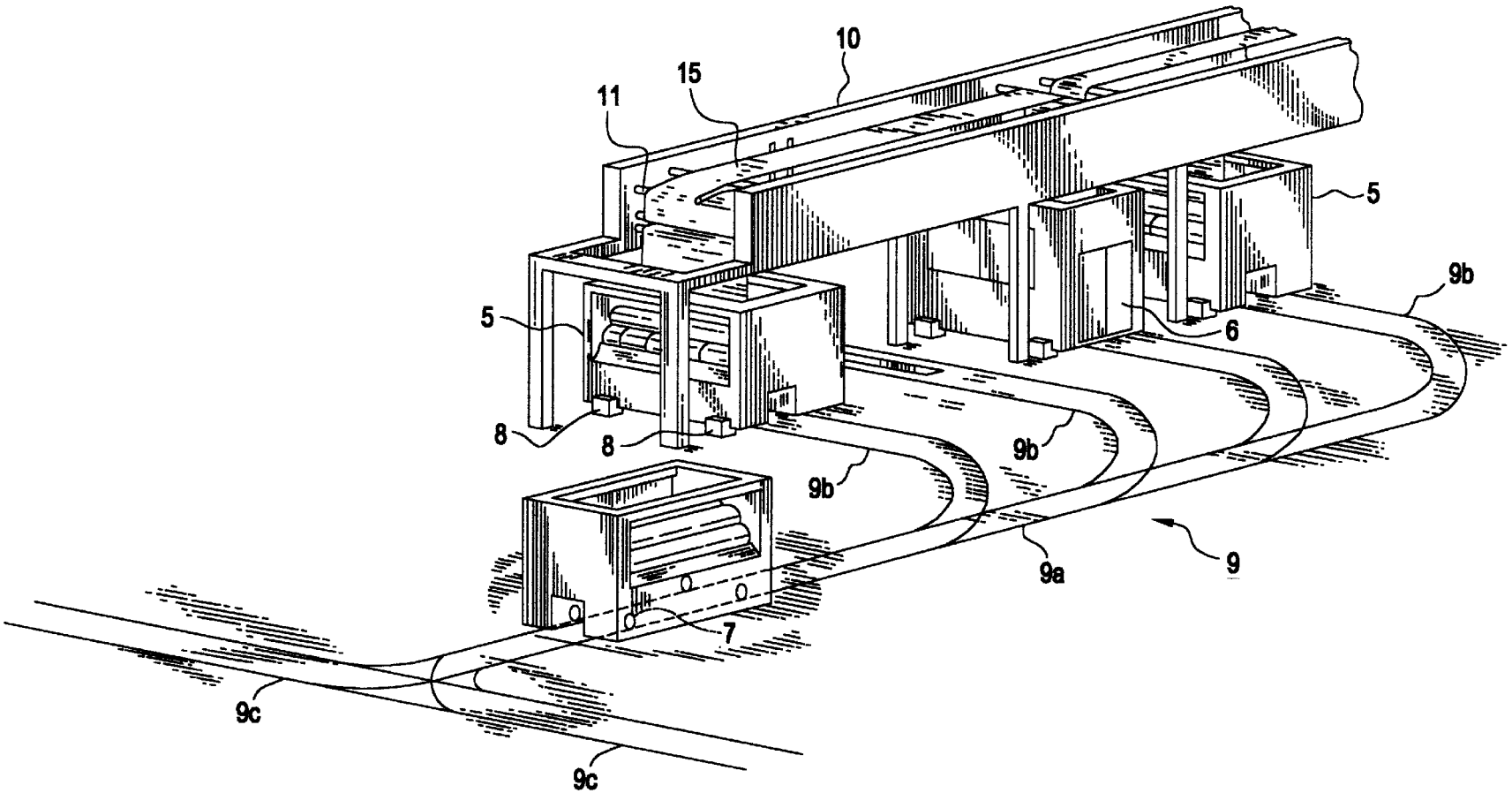
FIG. 1*b* is a perspective view fragmentarily illustrating the overall construction of a rotary press according to another embodiment of the present invention.
Figure 3:
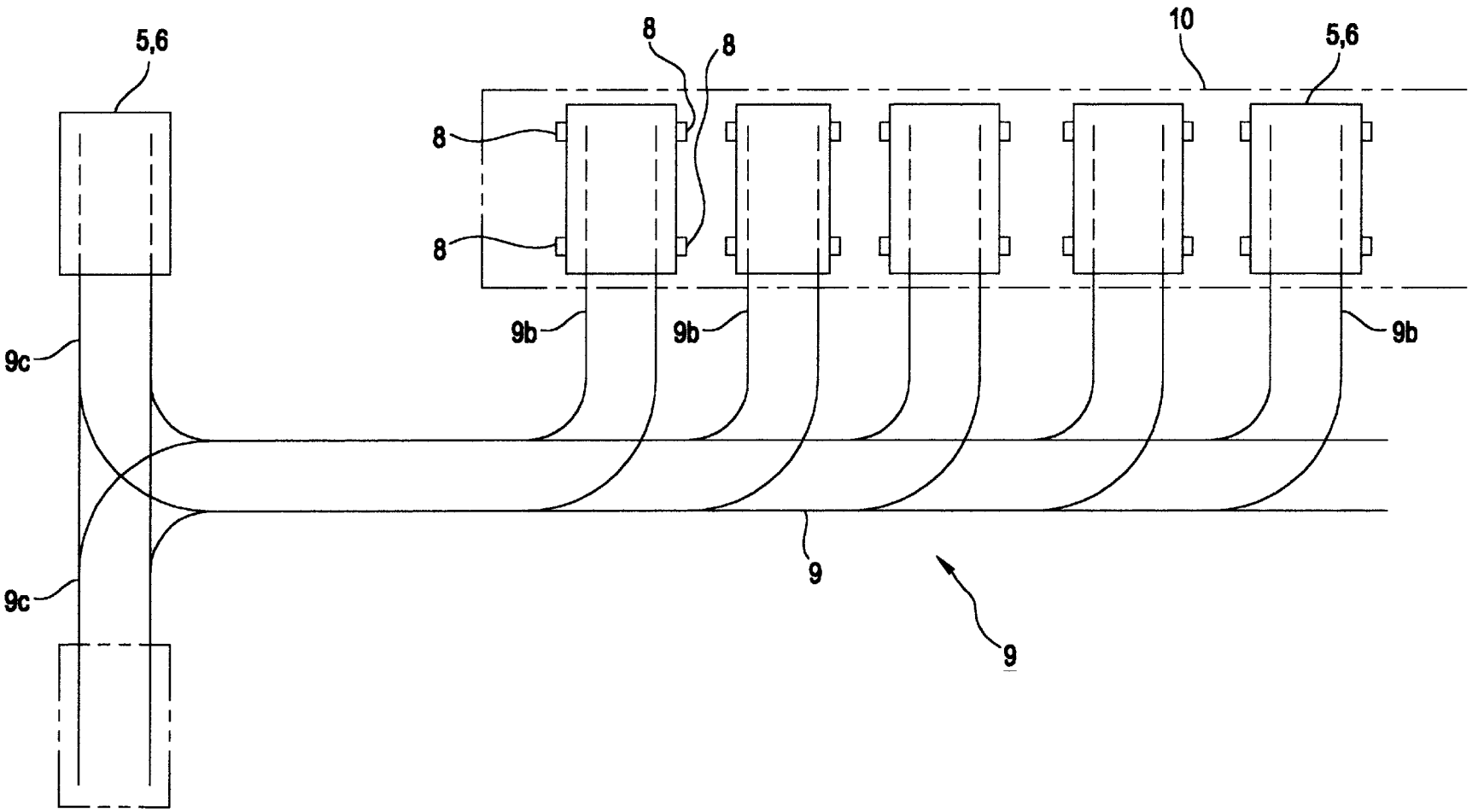
FIG. 3 is a plan view of the one embodiment of the rotary press shown in FIG. 1*a* or 1*b;*

Different from the printing units 5 and the folding unit 6 fixed on the machine base 4 as in the prior art, the printing units 5 and the holding unit 6 according to the present invention are constructed to be movable relative to the machine base 4. For this purpose, each unit is provided with a moving means 7, such as wheels. As shown in FIGS. 1*a*, 1*b* and 3, the moving means 7 is mounted on a moving guide means 9, such as rails, mounted on the floor 4*a*. With this construction, the printing units 5 and the folding unit 6 are movable manually or by not shown drive means, along the guide rails forming the moving guide means 9.

In FIGS. 1 and 3, the moving guide means 9, such as rails, includes a main line 9*a* having a length accepting at least two units simultaneously, and a plurality of branch lines 9*b*, 9*b*, 9*b*, 9*b* branching from the main line. Each branch line 9*b* is terminated at the working position of the printing unit 5 and the folding unit 6 at the end opposite to the branching end.

Therefore, as illustrated in FIG. 1, after arranging the printing unit 5 and/or the folding unit 6 from the working positions to the main line 9*a* through the corresponding branch lines 9*b*, they can be placed at desired working positions through desired branch lines. It should be convenient to form respective units in substantially equal size, particularly in equal width.

In addition, the main line 9*a* of the moving guide means 9 is provided with a orientation means. The orientation means can comprise a T-shaped branches 9*c* as shown in FIG. 1*a*. Utilizing such T-shaped branches 9*c*, the orientation of the units can be turned over 180°. In this case, it would be convenient to provide an extension for at least one of the T-shaped branches 9*c* to reach a factory for repairing or maintenance. As shown in FIG. 1*b* in the alternative, the orientation means may comprise a turn table 9*d* disposed in the main line 9*a*.

The printing units 5 and the folding unit 6 arranged at respective of the desired working position can be stationarily fixed in place on the floor 4*a* by means of fixing means 8.

For each of the printing units 5 and the folding units, one or more electric motors (not shown) are provided for operation independently of those of other units. A power supply cable, pipings for ink system, lubrication system, or for pneumatic pressure supply system and so forth are releasably connected to the units via appropriate couplers at the working position.

As means for introducing power to each unit for operation, it is possible to employ a driving primary shaft disengageably connected to the corresponding unit with interposing a clutch mechanism which is capable of engaging and disengaging for establishing and blocking power transmission path. Also, the ink and lubricant may be supplied from tanks and supply means incorporated in each unit independently of other units.

In FIG. 2, a rail frame 10 is mounted on the upper ends of the machine legs 13, 13. On the rail frame 10, a necessary minimum number of guide rollers 11 and turn bars 12 are arranged. By these turn bars 12 and the guide rollers 11, traveling or feeding path of the web 15 can be formed. The web feeding path is determined according to the fixed position of the upstream side printing unit.

It is also possible to integrally assemble the guide rollers 11 and the turn bars 12 at the upper position of each printing unit 5, and to integrally assemble the guide roller 6 above the folding unit 6 in the upper end of the folding unit 6. In this case, the rail frame becomes unnecessary to permit omission thereof.

Next, operation of the rotary press according to the present invention will be discussed herebelow. At first, before starting printing, the units 5 and 6 are arranged corresponding to a printing specification, such as page arrangement and position to insert a color print page and so forth. In order to enable this, the fixing means 8 are removed for releasing the units required to be re-arranged from the floor 4*a*. Also, the power cables or other wiring and pipings are disconnected from main cables and/or wiring and the main pipings at the couplers to enable the units to move.

To re-arrange the units, at least two units are moved away from the working positions to the main line 9*a* via respectively corresponding branch lines 9*b*. Then, respective units are moved into the desired working positions through the branch lines 9*b*.

When it is desired to reverse the orientation of the certain unit over 180°, the corresponding unit is moved to the orientation means 9*c* or 9*d* through the branch line 9*b* and the main line 9*a*. When the T-shaped branch 9*c* is employed as the orientation means, the unit is first moved to one end of the T-shaped branch 9*c* and then moved to the other end thereof. By this, the leading end and the trailing end of the units are reversed. Thereafter, the unit with the reversed orientation is moved into the desired working position via the main line 9*a* and the corresponding branch line 9*b*.

The units completing re-arrangement or reversing of the orientation are fixed on the floor by means of the fixing means 8. Also, the cable and/or wiring and the pipings are connected to the main cable or wiring and the main pipings via the couplers. Then, the web 15 extracted from the web roll 14 of the feeder unit 3 is inserted through the desired web feeding path. Then, the web 15 is further set through the desired feeing path through the guide rollers 11 and the turn bars 12 on the rail frame 10. Finally, the web 15 is set through the folding unit 6. After thus setting the web 15, the rotary press becomes ready for operation.

On the other hand, when the unit is desired to be moved out for repairing, maintenance or inspection, cleaning or so forth, the unit may be moved out of the working position and to the factory through the branch line 9*b*, the main line 9*a*, the T-shaped branch 9*c* and the extension extending from the T-shaped branch.

Variety of manner of piling of the webs by the effect of the rotary press according to the present invention will be discussed herebelow with reference to FIGS. 4 to 11. For simplification of disclosure, an example is taken to have two printing units P1 and P2 and one holding unit F.

At first, the positions of the units P1, P2 and F, and the manner of piling the webs W1 and W2 are assumed as basic arrangement and basic order.

Figure 4:
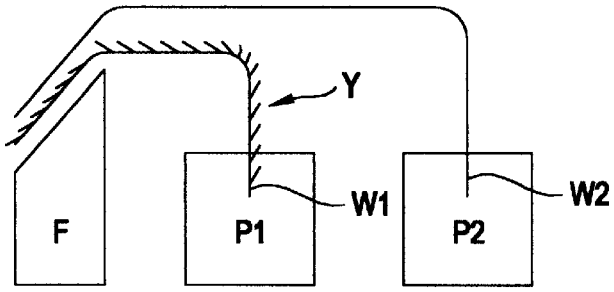
FIG. 4 is an explanatory illustration showing a basic order of piling of two webs W1 and W2 when two printing units P1 and P2 and one folding units are arranged in the basic arrangement.
Figure 5:
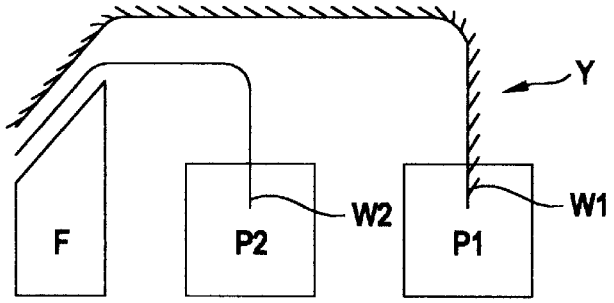
FIG. 5 is an explanatory illustration similarly to FIG. 4 but showing the arrangement where the printing units P1 and P2 are arranged at alternate positions to those of FIG. 4.

In the arrangement of FIG. 5, the folding unit F is maintained at the basic position. On the other hand, the two printing units P1 and P2 are reversed the positions relative to the positions in FIG. 4. In this case, the order of piling of the webs W1 and W2 becomes reversed to that in FIG. 1.

Figure 6:
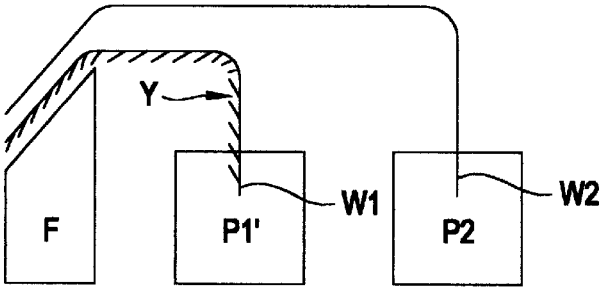
FIG. 6 is an explanatory illustration similar to FIG. 4, in which the printing units P1 and P2 are arranged in the similar arrangement to FIG. 4, but the printing unit P1 is turned over 180° so that the web W2 is piped on the reverse side of the web W1.

In the arrangement of FIG. 6, the folding unit F and the printing unit P2 are arranged at the basic positions corresponding to those in FIG. 4. On the other hand, the printing unit P1 is reversed over 180° in orientation to that of FIG. 1. In this case, the orientation of the web W1 is reversed to that of FIG. 1. Therefore, the web W1 is piled with the web W2 at the reversed side.

Figure 7:
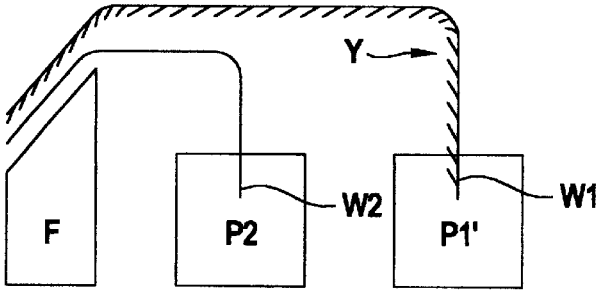
FIG. 7 is an explanatory illustration similarly to FIG. 6 but showing the arrangement where the printing units P1 and P2 are arranged at alternate positions to those of FIG. 6.

In the arrangement of FIG. 7, the folding unit F is maintained at the basic position. Two printing units P1 and P2 are reversed the positions relative to those in FIG. 4. In addition, one of the printing unit P1 is reversed in orientation over 180° relative to that of FIG. 4. In this case, the order of piling of the webs W1 and W2 is reversed to that of FIG. 4. In addition, the web W1 is piled with the web W2 at the reversed side.

Figure 8:
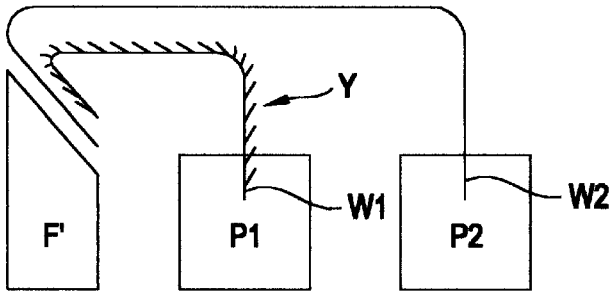
FIG. 8 is an explanatory illustration similarly to FIG. 4 but showing the arrangement where the folding units F is turned over 180° relative to the position illustrated in FIG. 4.

In the arrangement of FIG. 8, two printing units P1 and P2 are maintained at the basic positions of FIG. 4, and the folding unit F is reversed in the orientation with respect to that of FIG. 4. In this case, the webs W1 and W2 are piled substantially in the same manner to that of FIG. 7.

Figure 9:
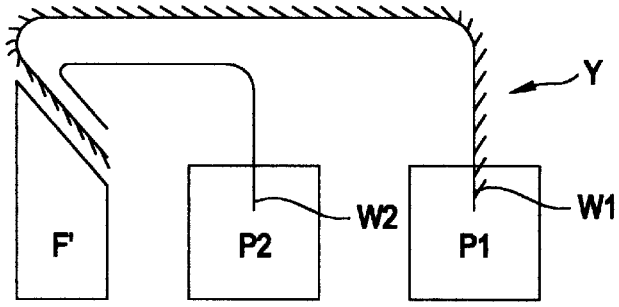
FIG. 9 is an explanatory illustration similarly to FIG. 8 but showing the arrangement where the printing units P1 and P2 are arranged at alternate positions to those of FIG. 8.

In the arrangement of FIG. 9, two printing units P1 and P2 are positioned are reversed positions with respect to those in FIG. 4. Also, the folding unit F is reversed in the orientation with respect to that of FIG. 4. In this case, the webs W1 and W2 are piled substantially in the same manner to that of FIG. 6.

Figure 10:
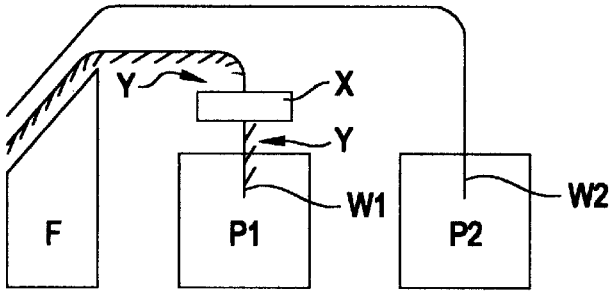
FIG. 10 is an explanatory illustration similarly to FIGS. 6 and 9 but showing the arrangement where a web reversing means X for reversing the web discharged from the printing unit P1 so that the web W1 is piled in the reverse condition relative to that of FIG. 4.

In the arrangement of FIG. 10, all of the units are arranged at the basic positions. In addition, a web reversing means X is provided for reversing the web W1 discharged from the printing unit P1. In this case, the webs W1 and W2 are piled substantially in the same manner to that of FIGS. 6 and 9.

Figure 11:
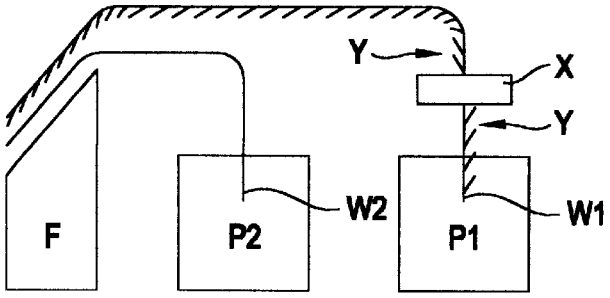
FIG. 11 is an explanatory illustration similarly to FIGS. 7 and 8 but showing the arrangement where the printing units P1 and P2 are arranged at alternate positions to those of FIG. 4 so that the order of piling of the webs W1 and W2 is alternated to that. of FIG. 4 and one of the web W1 is piled in the reverse position.

In the arrangement of FIG. 11, two printing units P1 and P2 are arranged at the reversed positions to those of FIG. 4. Also, the web reversing means X is provided for reversing the web W1 discharged from the printing unit P1. In this case, the webs W1 and W2 are piled substantially in the same manner to that of FIGS. 7 and 8.

As set forth, according to the present invention, since the printing units and/or the folding unit forming the rotary press can be re-arranged or re-oriented according to desired order of piling of the printed webs, the order of piling webs can be randomly varied. Therefore, the bay window device which requires a large number of guide rollers and the turn bars occupying large area can be omitted. Associated therewith, the path for feeding the paper can be simplified to avoid errors in operation. Also, the overall construction of the rotary press can be significantly simplified to contribute for reduction of the size and weight of the rotary press.

Furthermore, since the units can be moved away from the working position, repairing, maintenance or cleaning of the unit can be done at the factory or so forth, where the condition is adapted for operations of repairing, maintenance or cleaning. Therefore, it clearly improves efficiency of operation to permit resumption of operation easily and quickly. Furthermore, safety of the personnel can also be improved.

What is claimed is:

1. A method of varying an orientation of a unit in a printing system without removing the unit from track means on which the unit is disposed, said method comprising: providing the unit on the track means, said unit being located in a working position in a first orientation wherein the unit is engaged with a web; disengaging the web from the unit; moving the unit from the working position along the track means; rotating the unit 180° while the unit is on the track means; moving the unit along the track means back to the working position in a second orientation; and engaging the web with the unit, wherein the first orientation and second orientation vary by 180°.

2. The method as recited in claim 1, wherein the unit comprises at least one of a printing unit and a folding unit.

3. The method as recited in claim 1, further comprising disconnecting the unit from a power source while the unit is in the working position before moving the unit from the working position along the track means.

4. The method as recited in claim 1, further comprising moving the unit from the working position along the track means to a turntable, and rotating the turntable 180° while the unit is on the turntable and on the track means.

5. The method as recited in claim 1, further comprising moving the unit from the working position along the track means to a T-shaped branch of the track means, and manipulating the unit on the T-shaped branch to rotate the unit 180° before moving the unit along the track means to the working position and engaging the web with the unit.

6. A method of switching working positions of two units, a first unit and a second unit, in a printing system without removing the two units from track means on which the two units are disposed, said method comprising: providing the units on the track means, said first unit being located in a first working position in a first orientation wherein the first unit is engaged with a web, said second unit being located in a second working position in a second orientation wherein the second unit is engaged with the web; disengaging the web from the units; moving the first unit from the first working position along the track means; moving the second unit from the second working position along the track means; rotating the units 180° while the units are on the tack means; moving the first unit along the track means to the second working position in a third orientation; moving the second unit along the track means to the first working position in a fourth orientation; and engaging the web with the units, wherein the working positions of the units are switched in the printing system and orientations of each of the units are varied by 180°.

7. The method as recited in claim 6, wherein each of the first and second units comprises at least one of a printing unit and a folding unit.

8. The method as recited in claim 6, further comprising disconnecting the first unit from a power source while the first unit is in the first working position before moving the first unit from the first working position along the track means, and disconnecting the second unit from a power source while the second unit is in the second working position before moving the second unit from the second working position along the track means.

9. The method as recited in claim 6, further comprising moving at least one of the units along the track means to a turntable, and rotating the turntable 180° while the unit is on the turntable and on the track means.

10. The method as recited in claim 6, further comprising moving at least one of the units along the track means to a T-shaped branch of the track means, and manipulating the unit on the T-shaped branch to rotate the unit 180° before moving the unit along the track means and engaging the web with the unit.

11. A method of changing orientations of a plurality of units in a printing system without removing the units from track means on which the units are disposed, said method comprising: providing the units on the track means, said units being located in respective working positions, wherein the units are engaged with a web; disengaging the web from the units; moving the units from their respective working positions along the track means; rotating the units 180° while the units arc on the track means; moving the units along the track means back to their respective working positions; and re-engaging the web with the units, wherein the orientations of the units have been changed by 180°.

* * * * *